US005510961A

United States Patent [19]

Peng

[11] Patent Number: 5,510,961

[45] Date of Patent: Apr. 23, 1996

[54] CAP STRUCTURE WITH SOUND RECORDING AND GENERATING FUNCTIONS AND WARNING LIGHTS

[76] Inventor: Yu-Lin Peng, 6F, No. 335, Sec. 4, Pateh Road, Taipei, R.O.C., Taiwan

[21] Appl. No.: 445,459

[22] Filed: May 31, 1995

[51] Int. Cl.[6] ..... F21L 15/14

[52] U.S. Cl. ..... 362/106; 362/105; 362/800; D2/866; D26/39; 2/209.12; 2/906

[58] Field of Search ..... 362/105, 106, 362/800, 108, 103, 252, 802; D2/866, 872; D26/38, 39; 2/209.12, 906, 209.11, 209.13

[56] References Cited

U.S. PATENT DOCUMENTS

| | | | |
|---|---|---|---|
| D. 266,712 | 11/1982 | Van Valkenburgh | D26/39 |
| D. 318,338 | 7/1991 | Mitchell | D2/866 |
| 3,749,902 | 7/1973 | Drew | 362/106 |
| 4,231,079 | 10/1980 | Heminoyer | 362/106 |
| 4,525,878 | 7/1985 | Lowe, Jr. | 2/209.13 |
| 4,901,211 | 2/1990 | Shen | 362/105 |
| 4,999,747 | 3/1991 | Chen | 365/105 |

FOREIGN PATENT DOCUMENTS

| | | | |
|---|---|---|---|
| 2268043 | 1/1994 | United Kingdom | 362/105 |

*Primary Examiner*—James C. Yeung
*Attorney, Agent, or Firm*—Pro-Techtor International

[57] ABSTRACT

A cap structure with sound recording and generating means and warning lights includes digitalized sound recording and releasing means and light emitting diodes on a visor. A battery set and a circuit board are installed on the visor. The light emitting diodes may also be arranged on the ring of a crownless cap.

2 Claims, 4 Drawing Sheets

CAP STRUCTURE WITH SOUND RECORDING AND GENERATING FUNCTIONS AND WARNING LIGHTS

BACKGROUND OF THE INVENTION

The present invention relates generally to a cap structure, and particularly to a cap with sound recording and releasing functions and warning lights.

To protect the head from the sun, rain or wind, man has devised headgear like hats, caps and helmets. Hats or caps are most practical and handy. However, hats and caps are generally made for protecting the head and do not have any other major functions. There are some modifications to the design or outer appearance at most.

SUMMARY OF THE INVENTION

A primary object of the present invention is to provide a cap which, in additional to its protective function, has warning and entertaining effects, the cap being provided with lights which may act as warning lights for road construction workers, cyclists, etc. In particular, the cap provides good indicating and warning effects in case of accidents during hiking or camping.

According to the present invention, the cap structure is characterized in digitalized recording and generating means and light emitting diodes, which are controlled by a select switch in the visor. These major components are accommodated in the visor so that the overall design of the cap will not be affected. The present invention is suitable for crownless caps and ordinary caps. The light emitting diodes may be arranged on the ring of a crownless cap.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
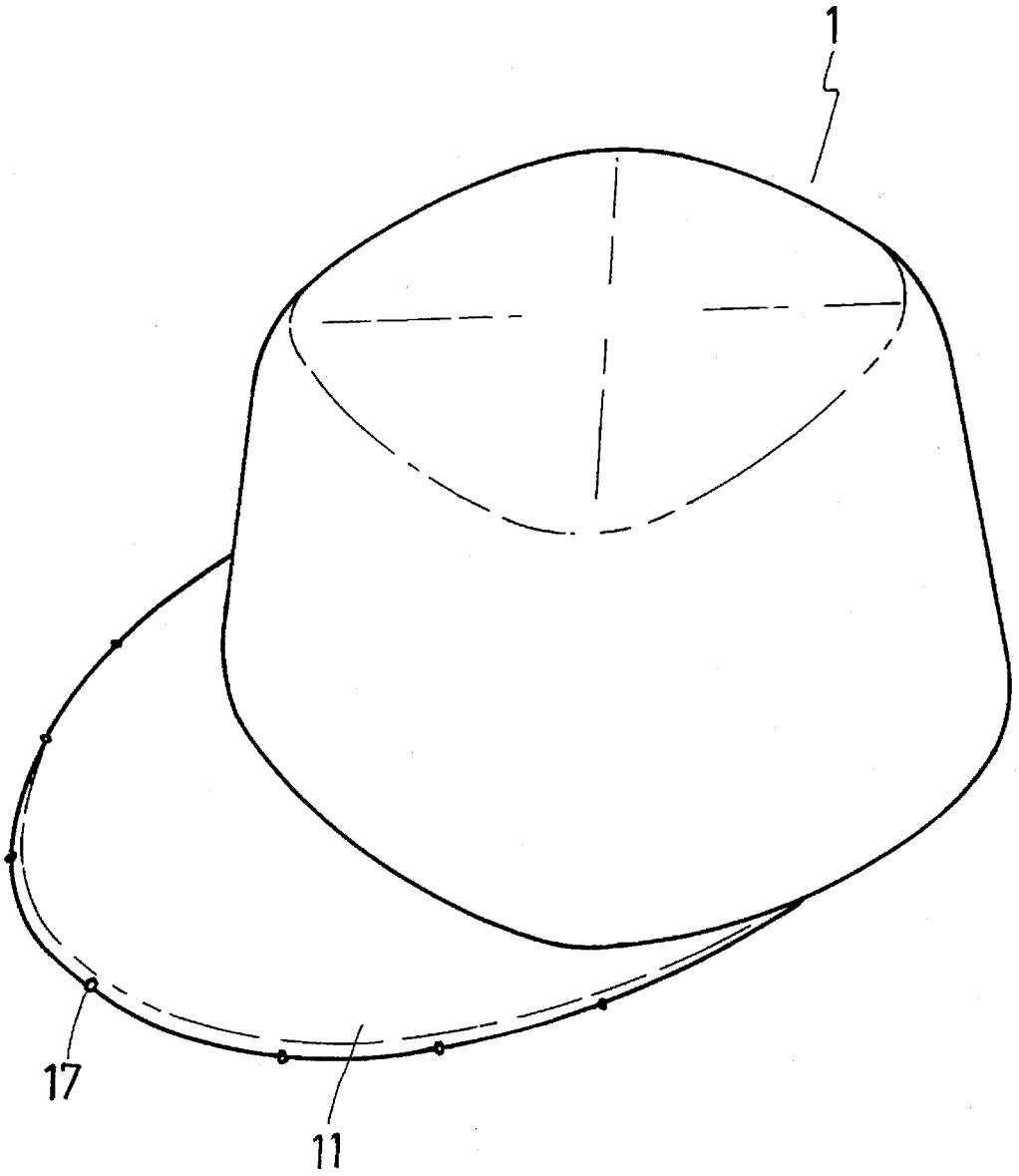
FIG. 1 is a perspective outer view of a preferred embodiment of the present invention.

As shown in the drawings, the present invention comprises a cap 1 integrally formed with a visor 11 and a ring 10. The underside of the visor 11 is provided with a recess

111. An outer rim of the recess 11 is provided with inverted fastening means 112. The recess 11 accommodates a battery set 12 containing a battery 121, a circuit board 13, a buzzer 14, a select switch 15 and a sound pick-up 16. Light emitting diodes (LED) are provided at the outer rim of the visor at suitable positions and are connected to the circuit board. The present invention further comprises a cover 2 having a shape substantially the same as that of the recess 111. The cover 2 is provided with a through hole 21 for exposing the sound pick-up 16, a sound hole 22 and a switch hole 23. The cover 2 may be pressed to fit into the recess 11 and positioned therein by means of the inverted fastening means 112 at the outer rim of the recess 11. The circuit board 13 in the recess 11 has a digitalized recording and generating circuit for recording sound and subsequently releasing it. For instance, when the user says "How are you?", the sound is recorded, digitalized and then released.

Figure 2:
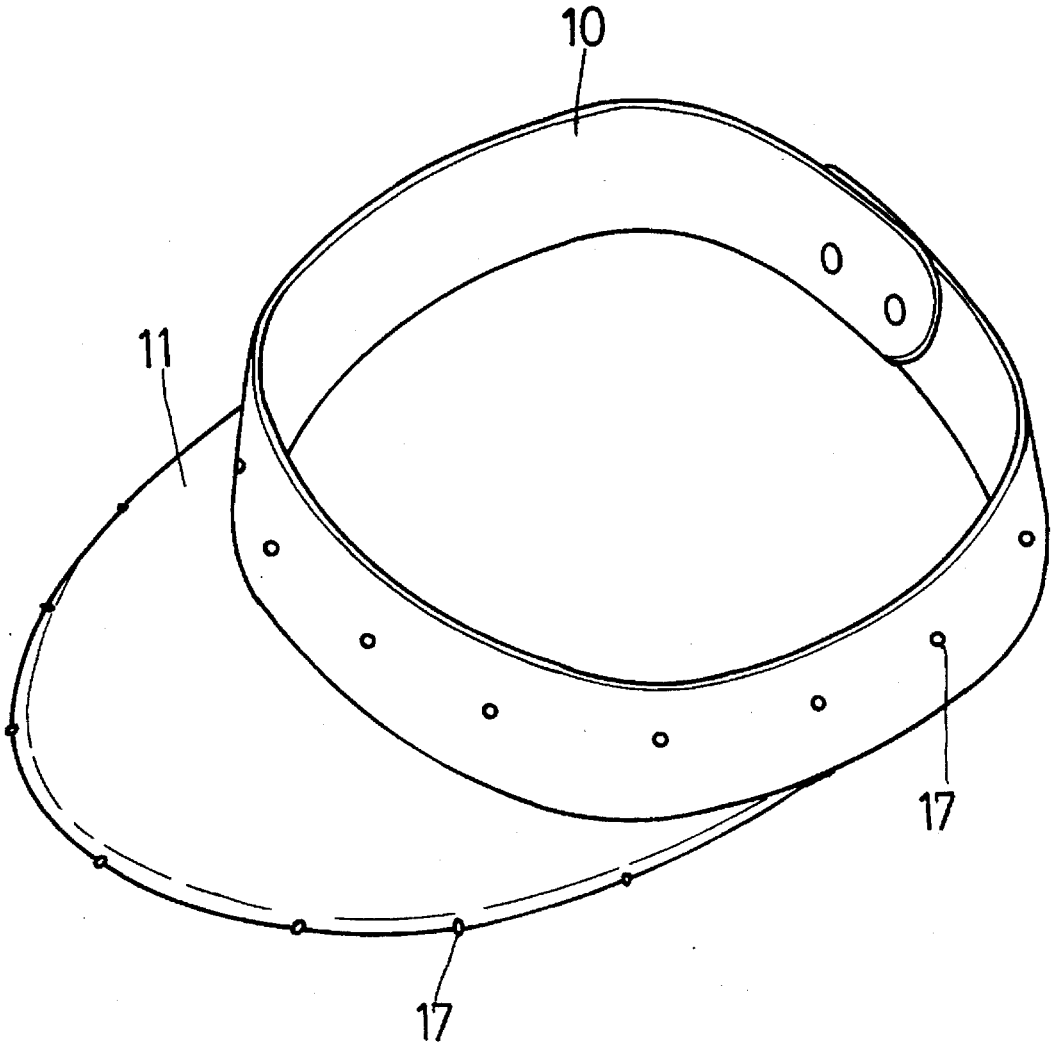
FIG. 2 is a perspective outer view of another preferred embodiment of the present invention.
Figure 3:
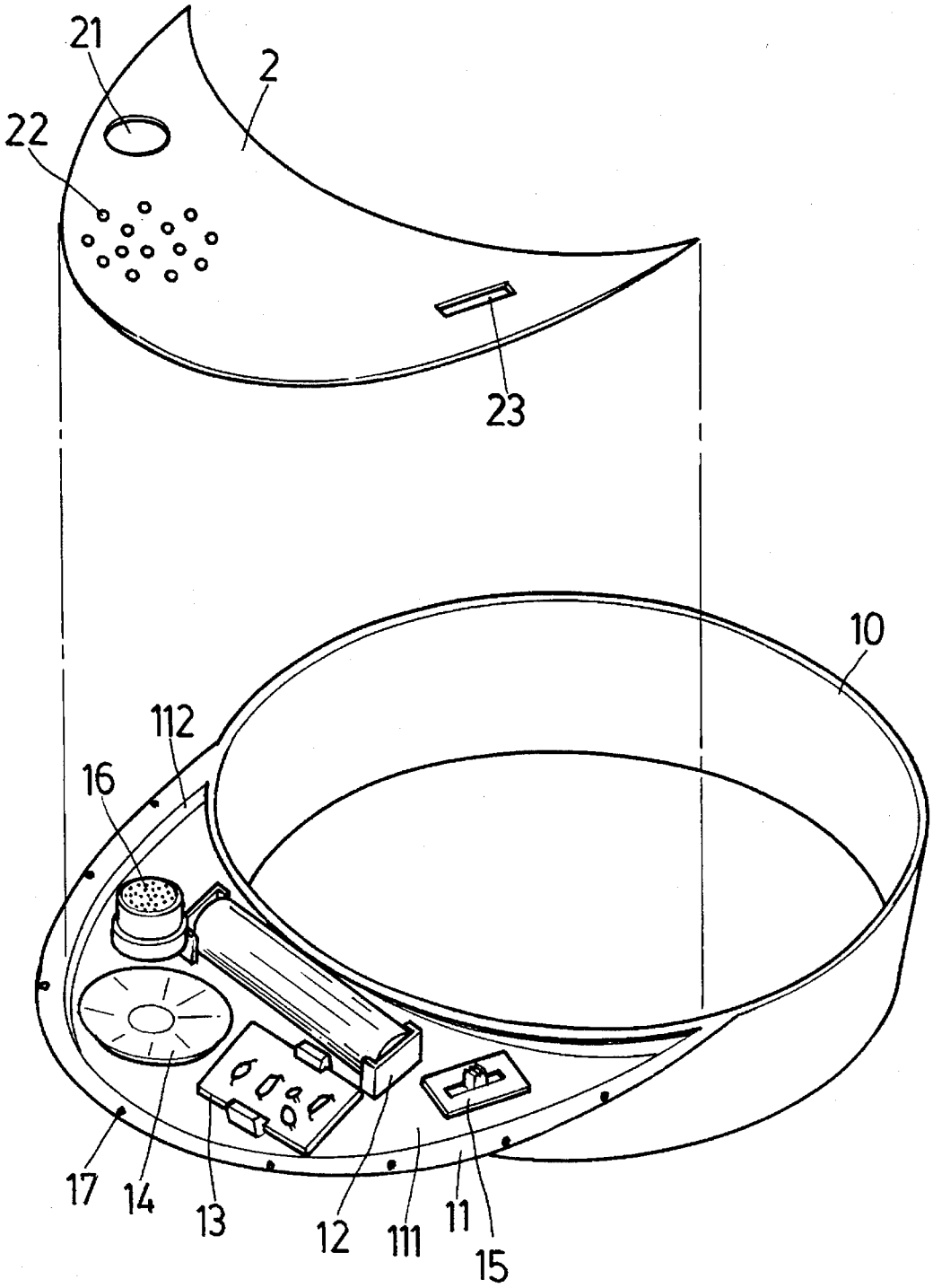
FIG. 3 is an exploded perspective outer view of the rear side of the main components of the present invention.
Figure 4:
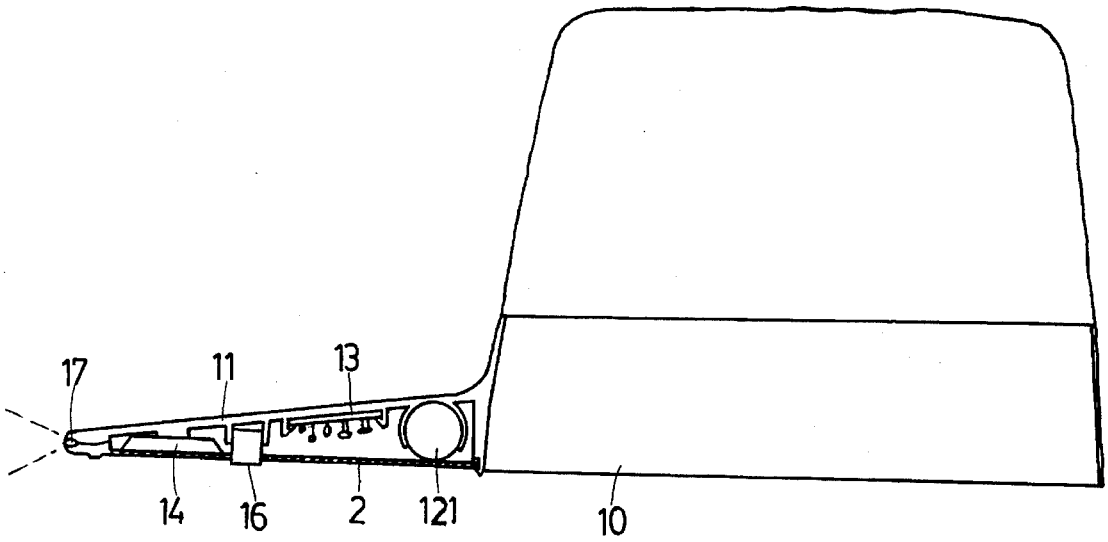
FIG. 4 is a sectional schematic view of the major parts of the present invention.

The light emitting diodes 17 on the visor may be a flickering type to provide novel and warning effects. When the present invention is adopted in a cap, the fabric material may be directed sewn to the ring 12 of the cap 1, as shown in FIGS. 1 and 2. When the present invention is used in a crownless cap such as that shown in FIG. 2, the light emitting diodes 17 may be arranged on the ring 12 to enhance the light effect.

Although the present invention has been illustrated and described with reference to the preferred embodiment thereof, it should be understood that it is in no way limited to the details of such embodiment but is capable of numerous modifications within the scope of the appended claims.

What is claimed is:

1. A cap structure having sound recording and generating functions and warning lights, said cap structure comprising a cap with a visor and a ring, a recess formed on an underside of said visor, said recess having an inverted fastening means at an outer rim thereof, said recess accommodating a battery set, a circuit board, a buzzer, a select switch and a sound pick-up, light emitting diodes being arranged on an outer rim of said visor at suitable positions and connected to said circuit board, said circuit board being provided with digitalized circuits to provide sound recording and releasing functions, said light emitting diodes for giving out flickering lights on the visor, said cap structure further comprising a cover pressed to fit into said recess and positioned therein by means of said inverting fastening means to tightly seal said recess, with said select switch and said sound pick-up protruding through said cover of said visor.

2. A cap structure as claimed in claim 1, wherein said cap is crownless and said light emitting diodes are additionally arranged on said ring of said cap for enhancing the lighting effects.

* * * * *